US012383074B2

(12) United States Patent
Thomas et al.

(10) Patent No.: US 12,383,074 B2
(45) Date of Patent: Aug. 12, 2025

(54) SPRING CORE WITH INTEGRATED CUSHIONING LAYER

(71) Applicant: Sealy Technology LLC, Trinity, NC (US)

(72) Inventors: Darin T. Thomas, Salisbury, NC (US); Stephen Wallace, Duffield, VA (US); Christina Pollock, Greensboro, NC (US)

(73) Assignee: SEALY TECHNOLOGY LLC, Trinity, NC (US)

( * ) Notice: Subject to any disclaimer, the term of this patent is extended or adjusted under 35 U.S.C. 154(b) by 0 days.

(21) Appl. No.: 18/758,771

(22) Filed: Jun. 28, 2024

(65) Prior Publication Data

US 2024/0349907 A1 Oct. 24, 2024

Related U.S. Application Data

(60) Division of application No. 17/354,498, filed on Jun. 22, 2021, now Pat. No. 12,048,380, which is a division of application No. 15/210,780, filed on Jul. 14, 2016, now Pat. No. 11,076,705, which is a continuation-in-part of application No. 14/717,245, filed on May 20, 2015, now Pat. No. 9,936,815.

(Continued)

(51) Int. Cl.

| | |
|---|---|
| ***A47C 27/14*** | (2006.01) |
| ***A47C 23/04*** | (2006.01) |
| ***A47C 27/045*** | (2006.01) |
| ***A47C 27/05*** | (2006.01) |
| ***A47C 27/06*** | (2006.01) |
| ***A47C 27/20*** | (2006.01) |

(52) U.S. Cl.

CPC ..... *A47C 27/20* (2013.01); *A47C 23/04* (2013.01); *A47C 27/0456* (2013.01); *A47C 27/056* (2013.01); *A47C 27/064* (2013.01)

(58) Field of Classification Search

CPC ... A47C 27/04; A47C 27/0456; A47C 27/064; A47C 27/056; A47C 27/0453; A47C 27/20; A47C 27/14; A47C 27/142; A47C 27/144; A47C 27/053; A47C 23/04

See application file for complete search history.

(56) References Cited

U.S. PATENT DOCUMENTS 1,205,406 A * 11/1916 Suekoff ..... A47C 27/063 5/655.8

1,262,814 A * 4/1918 Lewis ..... A47C 27/20 5/269

(Continued)

*Primary Examiner* — Justin C Mikowski
*Assistant Examiner* — Ifeolu A Adeboyejo
(74) *Attorney, Agent, or Firm* — Stites & Harbison, PLLC; Terry L. Wright

(57) ABSTRACT

A spring core is provided that includes a plurality of coil springs having an upper portion and a lower portion that collectively define an interior cavity. The spring core further includes a continuous upper fabric layer that covers each coil spring and defines a recess in the interior cavity of each coil spring. A cushioning layer is positioned atop the continuous upper fabric layer and extends into the recess in the interior cavity of each coil spring. A mattress assembly is further provided that includes the spring core, an upper body supporting layer, and a lower foundation layer. Methods of producing a spring core are further provided.

14 Claims, 6 Drawing Sheets

Related U.S. Application Data

(60) Provisional application No. 62/005,361, filed on May 30, 2014.

(56) References Cited

U.S. PATENT DOCUMENTS 1,287,662 A * 12/1918 Foster ..... A47C 27/064
5/655.8
1,755,715 A * 4/1930 Suekoff ..... A47C 27/05
5/721
2,121,417 A * 6/1938 Wolf ..... A47C 27/0453
5/721
2,345,675 A * 4/1944 Kibitz ..... A47C 27/0453
5/717
2,480,158 A * 8/1949 Owen ..... A47C 27/0453
5/721
3,010,122 A * 11/1961 Koenigsberg ..... A47C 27/053
5/721
3,719,963 A * 3/1973 Suekoff ..... A47C 27/20
264/46.7
3,732,586 A * 5/1973 Frey ..... A47C 27/20
5/718
3,818,560 A * 6/1974 Bulloch, Jr. ..... A47C 27/20
29/91.1
3,855,653 A * 12/1974 Stalter, Sr. ..... B29C 44/1266
297/DIG. 2
4,357,724 A * 11/1982 Laforest ..... A47C 27/081
297/DIG. 3
4,485,506 A * 12/1984 Stumpf ..... A47C 27/064
5/655.8
4,788,731 A * 12/1988 Yokoi ..... A47C 27/056
5/721
6,128,798 A * 10/2000 Barman ..... A47C 27/05
5/654.1
6,395,199 B1 * 5/2002 Krassowski ..... H01B 1/24
252/511
6,398,199 B1 * 6/2002 Barber ..... A47C 27/064
5/655.8
2007/0022538 A1 * 2/2007 Zschoch ..... A47C 23/002
5/655.8
2007/0044244 A1 * 3/2007 Ahn ..... B68G 7/054
5/717
2015/0342362 A1 * 12/2015 DeMoss ..... A47C 27/20
5/718

* cited by examiner

SPRING CORE WITH INTEGRATED CUSHIONING LAYER

RELATED APPLICATIONS

This Divisional Patent Application claims priority to and benefit of, under 35 U.S.C. § 121, U.S. Divisional patent application having Ser. No. 17/354,498, filed Jun. 22, 2021, which claims priority to and benefit of, under 35 U.S.C. § 121, U.S. Continuation-In-Part patent application having Ser. No. 15/210,780, filed Jul. 14, 2016, which claims priority to U.S. patent application having Ser. No. 14/717,245, now issued as U.S. Pat. No. 9,936,815, filed May 20, 2015, and which claims priority to U.S. Provisional Application Ser. No. 62/005,361, filed May 30, 2014, the entire disclosures of which are incorporated herein by reference.

TECHNICAL FIELD

The present invention relates to spring cores having an integrated cushioning layer. In particular, the present invention relates to spring cores that include a plurality of coil springs and a cushioning layer that is positioned atop the coil springs and that extends below an upper end convolution of each coil spring.

BACKGROUND

Spring assemblies that make use of pocket coil springs, which are also known as wrapped coils, encased coils, encased springs, or Marshall coils, are generally recognized as providing a unique feel to a mattress when used as a part of a spring assembly because each discrete coil is capable of moving independently to support the body of a user, or a portion thereof, resting on the mattress. In particular, in spring cores including a plurality of pocket coil spring assemblies, each coil is wrapped in a fabric pocket and moves substantially independently of the other coils in the spring core to thereby provide individualized comfort and contouring to the body of a user. Moreover, as a result of moving substantially independently from one another, the pocket coils also do not directly transfer motion from one pocket coil to another, and, consequently, the movement of one user resting on a mattress assembly using pocket coils will not disturb another user resting on the mattress assembly. In this regard, mattress assemblies constructed with a spring core using pocket coil springs are generally recognized as providing a soft and luxurious feel, and are often more desirable than a traditional inner spring mattress. Accordingly, a spring core that makes use of pocket coil springs and that further improves the unique feel and support provided by traditional pocket coil springs would be both highly desirable and beneficial.

SUMMARY

The present invention includes spring cores having an integrated cushioning layer. In particular, the present invention includes spring cores that are comprised of a plurality of coil springs and a cushioning layer that is positioned atop the coil springs and that extends below an upper end convolution of each coil spring.

In one exemplary embodiment of the present invention, an exemplary spring core is provided as part of a mattress assembly, which further includes an upper body supporting layer, a lower foundation layer, and a side panel extending between the upper body supporting layer and the lower foundation layer and around the entire periphery the spring core. The spring core itself is comprised of a plurality of coil springs with each of the coils having an upper portion and a lower portion that collectively define an interior cavity of the coil spring. Each of the coil springs is encased by a fabric pocket that includes a top area, which covers the upper portion of each coil spring, as well as a bottom area, which covers the lower portion of each coil spring. The spring core further includes a continuous upper fabric layer that covers the upper portion of each coil spring and that defines a recess in the interior cavity of each coil spring, an intermediate recess between each coil spring, or both. Additionally included in the spring core is a cushioning layer that is positioned atop each of the coil springs and that includes a bottom surface extending into each recess defined by the continuous upper fabric layer and a substantially planar top surface. In this regard, the top surface of the cushioning layer thus forms the first support surface of the spring core, while the bottom area of the fabric pockets along with the lower portion of each of the coil springs forms the second support surface of the spring core.

With respect to the fabric pockets, in some embodiments, the top area of each fabric pocket is connected to the bottom area of each fabric pocket within the interior cavity of the coil spring. The top area of the fabric pocket (i.e., the portion of the continuous upper fabric layer which forms the top area of the fabric pocket) can be connected to the bottom area of the fabric pocket by any number of means, including a tuft, a staple, a weld, and the like. By connecting the top area of the fabric pocket to the bottom area of the fabric pocket within the interior cavity of a coil spring, not only is it possible to impart a desired level of pre-compression, stability, and/or stretchability to the coil spring, but the connection of the top area of the fabric pocket to the bottom area of the fabric pocket also creates an additional recess that is defined by the top area of the fabric pocket and that, in certain embodiments, extends into the interior cavity of the coil spring to about half of the total height of the coil spring. In this regard, by joining the top area of a fabric pocket to the bottom area of a fabric pocket, the additional recess provides a suitable area in which the continuous upper fabric layer can extend and thereby defines the recess that is formed by the continuous upper fabric layer and that provides a suitable area onto which a liquid foam precursor can be directly dispensed and allowed to react to form the cushioning layer.

In another exemplary embodiment of the present invention, a spring core is included in an exemplary mattress assembly and comprises a plurality of mini coil springs that are each encased by a fabric pocket. The spring core further comprises a continuous upper fabric layer that extends across an upper portion of each of the plurality of mini coil springs and defines a recess in an interior cavity of each of the coil springs. The spring core then includes a continuous lower fabric layer that extends across the lower portion of each of the plurality of mini coil springs. The continuous lower fabric layer is connected to the continuous upper fabric layer around and between each of the plurality of mini coil springs, such that the continuous upper fabric layer and the continuous lower fabric layer collectively form a plurality of intermediate recesses between each of the mini coil springs. In this regard, when a liquid foam precursor is dispensed onto the continuous upper fabric layer, the resulting bottom surface of the cushioning layer extends into each of the recesses in the interior cavity of each of the mini coil springs and into each of the intermediate recesses between each of the mini coil springs.

As an even further refinement to the spring cores of the present invention that make use of a continuous upper fabric layer and a continuous lower fabric layer, in another embodiment, an exemplary spring core is includes a plurality of mini coil springs similar to the embodiment described above, but which are each not surrounded by a fabric pocket. Instead, in the further spring core, the continuous upper fabric layer and the continuous lower fabric layer are connected to one another between each of the mini coil springs and to one another within the interior cavity of each of the mini coil springs to define both a recess in the interior cavity of each of the mini coil springs and a plurality of intermediate recesses between each of the mini coil springs.

Still further provided are methods for producing a spring core. In one exemplary implementation of a method for producing a spring core, a pocketed coil array is first provided and is covered by a continuous upper fabric layer to define a recess in the interior cavity of each coil spring. A foam precursor is then dispensed onto the continuous upper fabric layer, for example, by moving the pocketed coil array through a flowing vertical curtain of foam precursor, and the top surface of the foam precursor is subsequently smoothed. The pocket coil array with the foam precursor dispensed on the continuous upper fabric layer is then cured, such as by advancing the array through an infrared curing oven or by other means for curing the foam (e.g., humidity, ultraviolet light, etc.) where the time spent in curing the foam is predetermined to adequately cure the foam precursor into the set foam layer. After the foam precursor has reacted for an appropriate amount of time and the foam precursor has set, the edges of the set foam are then trimmed to produce the exemplary spring core of the present invention.

Further features and advantages of the present invention will become evident to those of ordinary skill in the art after a study of the description, figures, and non-limiting examples in this document.

BRIEF DESCRIPTION OF THE DRAWINGS

FIG. I is a perspective view of an exemplary mattress assembly made in accordance with the present invention, with a portion of the mattress assembly removed to show a spring core in the interior of the mattress assembly.

DESCRIPTION OF EXEMPLARY EMBODIMENTS

The present invention includes spring cores having an integrated cushioning layer. In particular, the present invention includes spring cores that are comprised of a plurality of coil springs and a cushioning layer that is positioned atop the coil springs and that extends below an upper end convolution of each coil spring.

Figure 1:
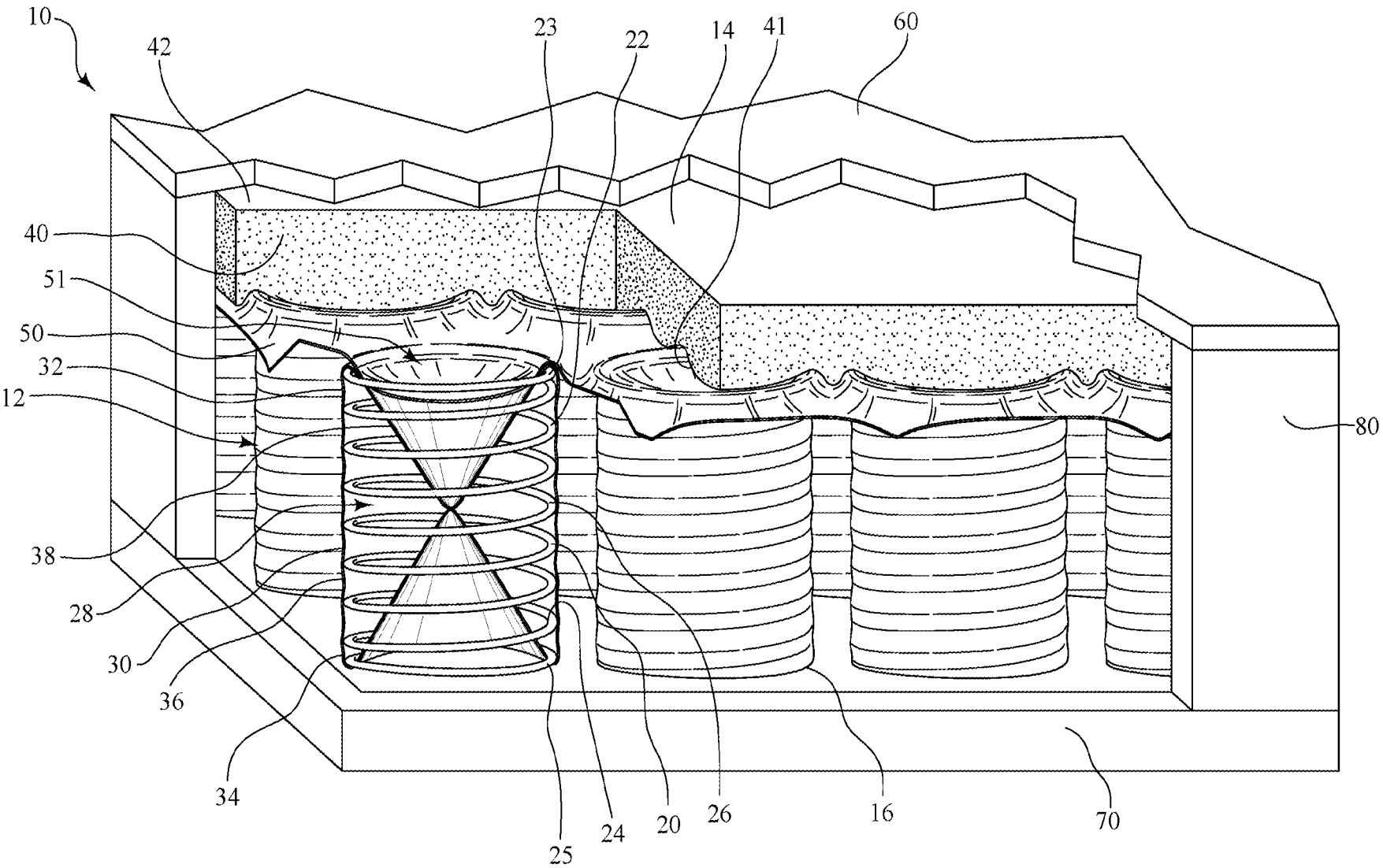

Referring first to FIG. 1, in one exemplary embodiment of the present invention, an exemplary spring core 12 is provided as part of a mattress assembly 10. The spring core 12 includes a plurality of coil springs 20 with each of the coil springs 20 having an upper portion 22 and a lower portion 24 that collectively define an interior cavity 28 of the coil spring 20. Each of the coil springs 20 is encased by a fabric pocket 30 that includes a top area 32, which covers the upper portion 22 of the coil spring 20, as well as a bottom area 34, which covers the lower portion 24 of the coil spring 20. The spring core 12 further includes a continuous upper fabric layer 50 that covers and, consequently, operably connects the upper portions 22 of each coil spring 20 to one another and that defines a recess 51 in the interior cavity 28 of each coil spring 20. Additionally included in the exemplary spring core 12 is a cushioning layer 40 that is positioned atop each of the coil springs 20 and that includes a bottom surface 41 extending into each recess 51 defined by the continuous upper fabric layer 50 and a substantially planar top surface 42 extending over each of the coil springs 20. In this regard, the top surface 42 of the cushioning layer 40 thus forms the first support surface 14 of the spring core 12, while the bottom area 34 of each of the fabric pockets 30 along with the lower portion 24 of the coil springs 20 forms the second support surface 16 of the spring core 12.

With respect to each of the coil springs 20, each exemplary coil spring 20 shown in FIG. 1 is made of a continuous wire that extends from an upper end convolution 23 at the upper portion 22 of the coil spring 20 to a lower end convolution 25 opposite the upper end convolution 23 at the lower portion 24 of the coil spring 20. In the coil spring 20, there are seven intermediate convolutions 26 that helically spiral between the upper end convolution 23 and the lower end convolution 25, such that the coil spring 20 is made of a total of nine convolutions or turns. Of course, various other springs, such as coil springs having a different number of convolutions, could also be used in an exemplary pocket coil spring assembly without departing from the spirit and scope of the present invention.

With respect to the fabric pockets 30, in the exemplary spring core 12 shown in FIG. 1, the top area 32 and the bottom area 34 of each of the fabric pockets 30 extend along the outside of the coil spring 20 and form a generally cylindrical (or tubular) side surface 36 of the fabric pocket 30. In this regard, the fabric pocket 30 is preferably made of a non-woven fabric which can be joined or welded together by heat and pressure (e.g., via ultrasonic welding or by a similar thermal welding procedure) to form such a cylindrical structure. For example, suitable fabrics that can be used for the fabric pocket 30 can include one of various thermoplastic fibers known in the art, such as non-woven polymer-based fabric, non-woven polypropylene material, or non-woven polyester material.

With further respect to the fabric pocket 30 and referring still to FIG. 1, which shows a portion of the side surface 36 of one of the fabric pockets 30 removed to reveal the coil spring 20 and interior of the fabric pocket 30, the top area 32 of the fabric pocket 30 is connected to the bottom area 34 of the fabric pocket 30 within the interior cavity 28 of the coil spring 20. The top area 32 of the fabric pocket 30 can be connected to the bottom area 34 of the fabric pocket 30 by any number of means, including a tuft, a staple, a weld, glue, stitches, clamps, hook-and-loop fasteners, and the like.

By connecting the top area 32 of the fabric pocket 30 to the bottom area 34 of the fabric pocket 30 within the interior cavity 28 of the coil spring 20, not only is it possible to impart a desired level of pre-compression, stability, and/or stretchability to the coil spring 20, but the connection of the top area 32 of the fabric pocket 30 to the bottom area 34 of the fabric pocket 30 also creates an additional recess 38 that is defined by the top area 32 of the fabric pocket 30 and that extends into the interior cavity 28 of the coil spring 20 to about half of the total height of the coil spring 20. In the exemplary embodiment shown in FIG. 1, the top area 32 of the fabric pocket 30 is connected to the bottom area 34 of the fabric pocket 30 at approximately the center of the interior cavity 28 of the coil spring 20, such that the additional recess 38 that is formed has a substantially conical shape. It is of course appreciated that depending on the manner in which the top area 32 of the fabric pocket 30 is joined to the bottom area 34 of the fabric pocket 30, the additional recess 38 can also be made to have a different shape. For example, by increasing the size of the connected portion within the interior cavity 28 of the coil spring 20, a recess could be formed in the shape of a truncated cone, cylinder, or the like. Regardless of the particular shape of the additional recess 38, however, by joining the top area 32 of the fabric pocket 30 to the bottom area 34 of the fabric pocket 30, the additional recess 38 provides a suitable area in which the continuous upper fabric layer 50 can extend below the upper end convolution 23 of the coil spring 20 and thereby define the recess 51 that is formed by the continuous upper fabric layer 50 and that provides a suitable area onto which a liquid foam precursor can be directly dispensed and allowed to react to form the cushioning layer 40, as described in further detail below.

Referring still to FIG. 1, the cushioning layer 40 included in the spring core 12 of the mattress assembly 10 is generally comprised of a type of flexible foam having a density suitable for supporting and distributing pressure from a user's body, or portion thereof, resting on the mattress assembly 10. Such flexible foams include, but are not limited to: latex foam; reticulated or non-reticulated visco-elastic foam (sometimes referred to as memory foam or low-resilience foam); reticulated or non-reticulated non-visco-elastic foam; high-resilience polyurethane foam; expanded polymer foams (e.g., expanded ethylene vinyl acetate, polypropylene, polystyrene, or polyethylene); and the like. In the exemplary embodiment shown in FIG. 1, the cushioning layer 40 is comprised of a two-part polyurethane foam that can be dispensed as a liquid foam precursor directly onto the continuous upper fabric layer 50 and into the recess 51 defined by the continuous upper fabric layer 50 such that the liquid reacts and bonds to the continuous upper fabric layer 50.

With respect to hardness, the flexible foam used in the cushioning layer 40 of the spring core 12 can, in some embodiments, have a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the flexible foam used in the cushioning layer 40 included in spring core 12 of the mattress assembly 10 has a hardness of about 10 N, about 20 N, about 30 N, about 40 N, about 50 N, about 60 N, about 70 N, or about 80 N to provide a desired degree of comfort and body-conforming or supporting qualities.

With respect to density, the flexible foam used in the cushioning layer 40 of the spring core 12 can, in some embodiments, also have a density that assists in providing a desired degree of comfort and body-conforming qualities, as well as an increased degree of material durability. In some embodiments, the density of the flexible foam used in the cushioning layer 40 included in the spring core 12 of the mattress assembly 10 has a density of no less than about 30 $kg/m^3$ to no greater than about 150 $kg/m^3$. In some embodiments, the density of the flexible foam used in the cushioning layer 40 of the spring core 12 is about 10 $kg/m^3$, about 20 $kg/m^3$, about 30 $kg/m^3$, about 40 $kg/m^3$, about 50 $kg/m^3$, about 60 $kg/m^3$, about 70 $kg/m^3$, about 80 $kg/m^3$, about 90 $kg/m^3$, about 100 $kg/m^3$, about 110 $kg/m^3$, about 120 $kg/m^3$, about 130 $kg/m^3$, about 140 $kg/m^3$, or about 150 $kg/m^3$. In some embodiments, the density of the flexible foam used in the cushioning layer 40 of the spring core 12 is about 10 $kg/m^3$ to about 80 $kg/m^3$. Of course, the selection of a flexible foam having a particular density will affect other characteristics of the foam, including its hardness, the manner in which the foam responds to pressure, and the overall feel of the foam. In this regard, it is also appreciated that a flexible foam having a desired density and hardness can readily be selected for a particular mattress assembly or application as desired. However, regardless of the particular properties of the cushioning layer 40, a user's body, or portion thereof, resting on the mattress assembly 10 will be supported by both the cushioning layer 40 as well as the coil springs 20, and thus, will provide a user with the contact feel of foam along with the durability and support of a spring.

Furthermore, and as indicated above, the cushioning layer 40 in the exemplary spring core 12 shown in FIG. 1 is typically formed from a two-part polyurethane foam, but it is appreciated that other materials can also be used in addition to or instead of a foam, such as a gel or a fibrous fill material. For example, in some embodiments, the cushioning layer can comprise a latex foam that is dispensed as a liquid latex composition which is then cured into a solid latex foam, according to methods known in the art. Such latex foam embodiments can also be made to have a desired density and hardness that can readily be selected for a particular mattress assembly or application as desired.

In other embodiments, the cushioning layer can comprise an elastomeric gelatinous material that is capable of providing a cooling effect by acting as a thermal dump or heat sink into which heat from a user's body, or portion thereof, positioned on the cushioning layer can dissipate. For example, in such embodiments, the cushioning layer can be comprised of a polyurethane-based gel made by combining Hyperlast® LU 1046 Polyol, Hyperlast® LP 5613 isocyanate, and a thermoplastic polyurethane film, which are each manufactured and sold by Dow Chemical Company Corp. (Midland, MI), and which can be combined to produce a gel having a thermal conductivity of 0.1776 W/m*K, a thermal diffusivity of 0.1184 mm2/s, and a volumetric specific heat of 1.503 MJ (/m3K) as established by the International Organization of Standardization (ISO) 22007-2 volumetric specific heat measuring standard.

Furthermore, it is appreciated that the wire gauge, spring constant, pre-compression, and overall geometry of the coil spring used in a particular mattress assembly can also be readily varied and used to impart a particular feel or characteristic in an exemplary mattress assembly without departing from the spirit and scope of the present invention.

Referring still to FIG. 1, and as noted above, the exemplary spring core 12 is typically provided as part of a mattress assembly 10 made in accordance with the present invention. In this regard, in addition to the spring core 12, the exemplary mattress assembly 10 further comprises an upper body supporting layer 60 positioned adjacent to the first support surface 14 of the spring core 12, and a lower foundation layer 70 positioned adjacent to the second support surface 16 of the spring core 12. A side panel 80 then extends between the upper body supporting layer 60 and the lower foundation layer 70 and around the entire periphery of the spring core 12 such that the plurality (i.e., the matrix) of the coil springs 20 is surrounded.

In the exemplary embodiment shown in FIG. 1, the upper body supporting layer 60 is comprised of a visco-elastic foam, however, it is contemplated that the upper body supporting layer 60 can alternatively be comprised of some combination of foam, upholstery, and/or other soft, flexible materials known in the art. Furthermore, the upper body supporting layer 60 can also be comprised of multiple layers of material configured to improve the comfort or support of the upper body supporting layer 60. In contrast to the upper body supporting layer 60, the lower foundation layer 70 is generally comprised of a piece of wood, or other similarly rigid member, and is configured to support the plurality of coil springs 20.

As a refinement of the spring cores and mattress assemblies of the present invention, rather than making use of a plurality of coil springs encased by fabric pockets and then covered by a continuous upper fabric layer that only connects the upper portions of each coil spring to one another, it is also contemplated that a plurality of coil springs can be covered by both a continuous upper fabric layer and a continuous lower fabric layer that are then connected to each other to provide a more unitary spring core construction. For example, and referring now to FIG. 2, in another exemplary embodiment of the present invention, an exemplary spring core 112 is provided as part of another exemplary mattress assembly 110 made in accordance with the present invention. The spring core 112 is comprised of a plurality of mini coil springs 120 that, similar to the coil springs 20 in the spring core 12 shown in FIG. 1, each have an upper portion 122 and a lower portion 124 that collectively define an interior cavity 128 of each mini coil spring 120. Each of the mini coil springs 120 is also made of a continuous wire that extends from an upper end convolution 123 at the upper portion 122 of each mini coil spring 120 to a lower end convolution 125 opposite the upper end convolution 123 at the lower portion 124 of each mini coil spring 120. Each of the mini coil springs 120 is also encased by a fabric pocket 130 that includes a top area 132, which covers the upper portion 122 of each mini coil spring 120, and a bottom area 134, which covers the lower portion 124 of each mini coil spring 120. However, unlike the coil springs 20 described above with reference to FIG. 1, there are only three intermediate convolutions 126 that helically spiral between the upper end convolution 123 and the lower end convolution 125, such that each mini coil spring 120 shown in FIG. 2 is made of a total of five convolutions or turns and has a height that is substantially less than the height of each of the coil springs 20 shown in FIG. 1.

Figure 2:
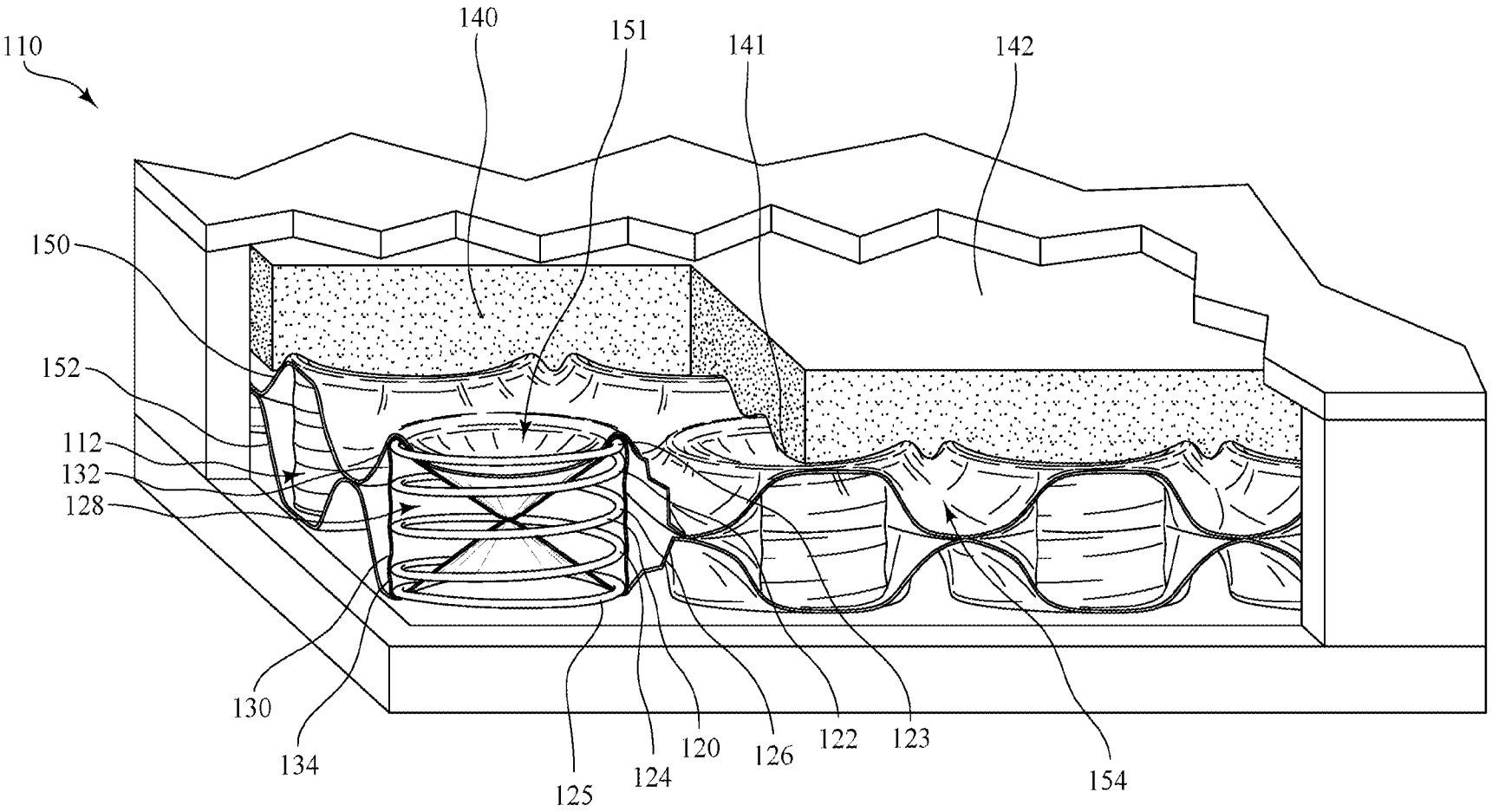
FIG. 2 is a perspective view of another exemplary mattress assembly made in accordance with the present invention, with a portion of the mattress assembly removed to show a spring core in the interior of the mattress assembly.

Referring still to FIG. 2, the exemplary spring core 112 further includes a continuous upper fabric layer 150 which covers the upper portion 122 of each of the plurality of mini coil springs 120 and extends below the upper end convolution 123 of each mini coil spring 120 to define a recess 151 in the interior cavity 128 of each of the mini coil springs 120. Like the spring core 12 shown in FIG. 1, a cushioning layer 140 having a bottom surface 141 and a top surface 142 is additionally included in the spring core 112, and is positioned atop the mini coil springs 120. Unlike the coil springs 20 described above with reference to FIG. 1 though, the cushioning layer 140 does not extend below the upper end convolutions 123 of each mini coil spring 120 into only the recess 151 defined by the continuous upper fabric layer 150 in the interior cavity 128 of each of the mini coil springs 120. Rather in the spring core 112, a continuous lower fabric layer 152 is further included that extends beneath the lower portion 124 of each of the plurality of mini coil springs 120, and is connected to the continuous upper fabric layer 150 around and between each of the plurality of mini coil springs 120 to define intermediate recesses 154 between each of the mini coil springs 120. In this regard, and as described in further detail below, when a liquid foam precursor is directly dispensed onto the continuous upper fabric layer 150 in order to form the cushioning layer 140, the resulting bottom surface 141 of the cushioning layer 140 extends below the upper end convolutions 123 of each mini coil spring 120 into each of the recesses 151 in the interior cavity 128 of each of the mini coil springs 120 and additionally into each of the intermediate recesses 154 between each of the mini coil springs 120.

Figure 3:
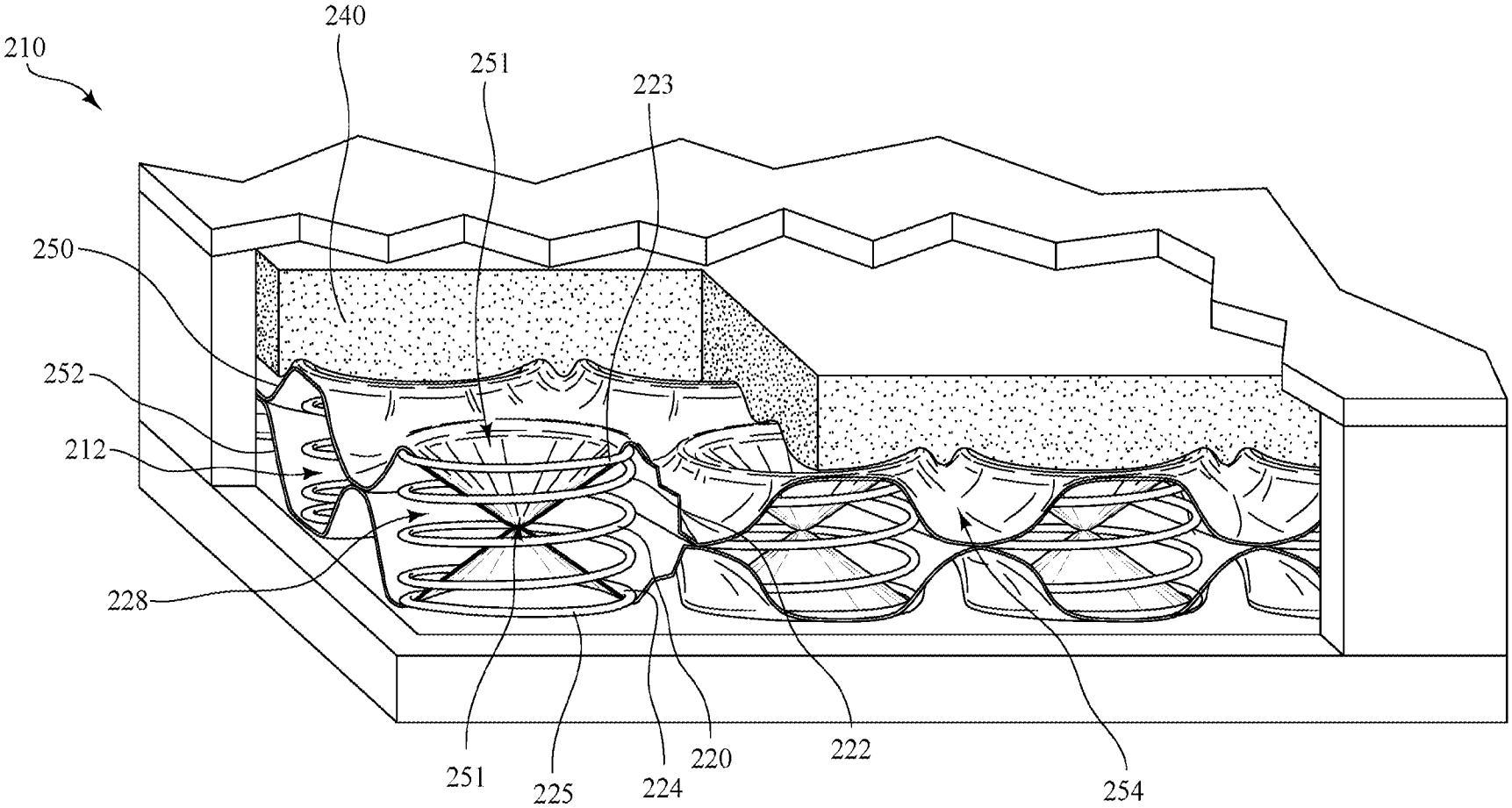
FIG. 3 is a perspective view of another exemplary mattress assembly made in accordance with the present invention, with a portion of the mattress assembly removed to show a spring core in the interior of the mattress assembly.

As an even further refinement to the spring cores of the present invention that make use of a continuous upper fabric layer and a continuous lower fabric layer to provide a spring core having a more unitary construction, and referring now to FIG. 3, an exemplary spring core 212 is provided as part of a mattress assembly 210, where the spring core 212 includes a plurality of mini coil springs 220 having an upper portion 222 with an upper end convolution 223 of the mini coil spring 220 and a lower portion 224 with a lower end convolution 225 of the mini coil spring 220. The upper portion 222 and the lower portion 224 of the mini coil spring 220 collectively define an interior cavity 228 of each mini coil spring 220. The spring core 212 additionally includes a cushioning layer 240, a continuous upper fabric layer 250, and a continuous lower fabric layer 252 similar to the spring core 112 described above with respect to FIG. 2. Unlike the spring core 112 shown in FIG. 2, however, each of the mini coil springs 220 are not surrounded by a fabric pocket. Instead, in the spring core 212, the continuous upper fabric layer 250 and the continuous lower fabric layer 252 are connected to one another between each of the mini coil springs 220 and are connected to one another within the interior cavity 228 of each of the mini coil springs 220 to define both a recess 251 in the interior cavity 228 of each of the mini coil springs 220 and a plurality of intermediate recesses 254 between each of the mini coil springs 220. Accordingly, and as shown in FIG. 3, the cushioning layer 240 extends below the upper end convolution 223 of the mini coil springs 220 into the recess 251 in the interior cavity 228 of each of the mini coil springs 220, and additionally into the plurality of intermediate recesses 254 between each of the mini coil springs 220.

Figure 4:
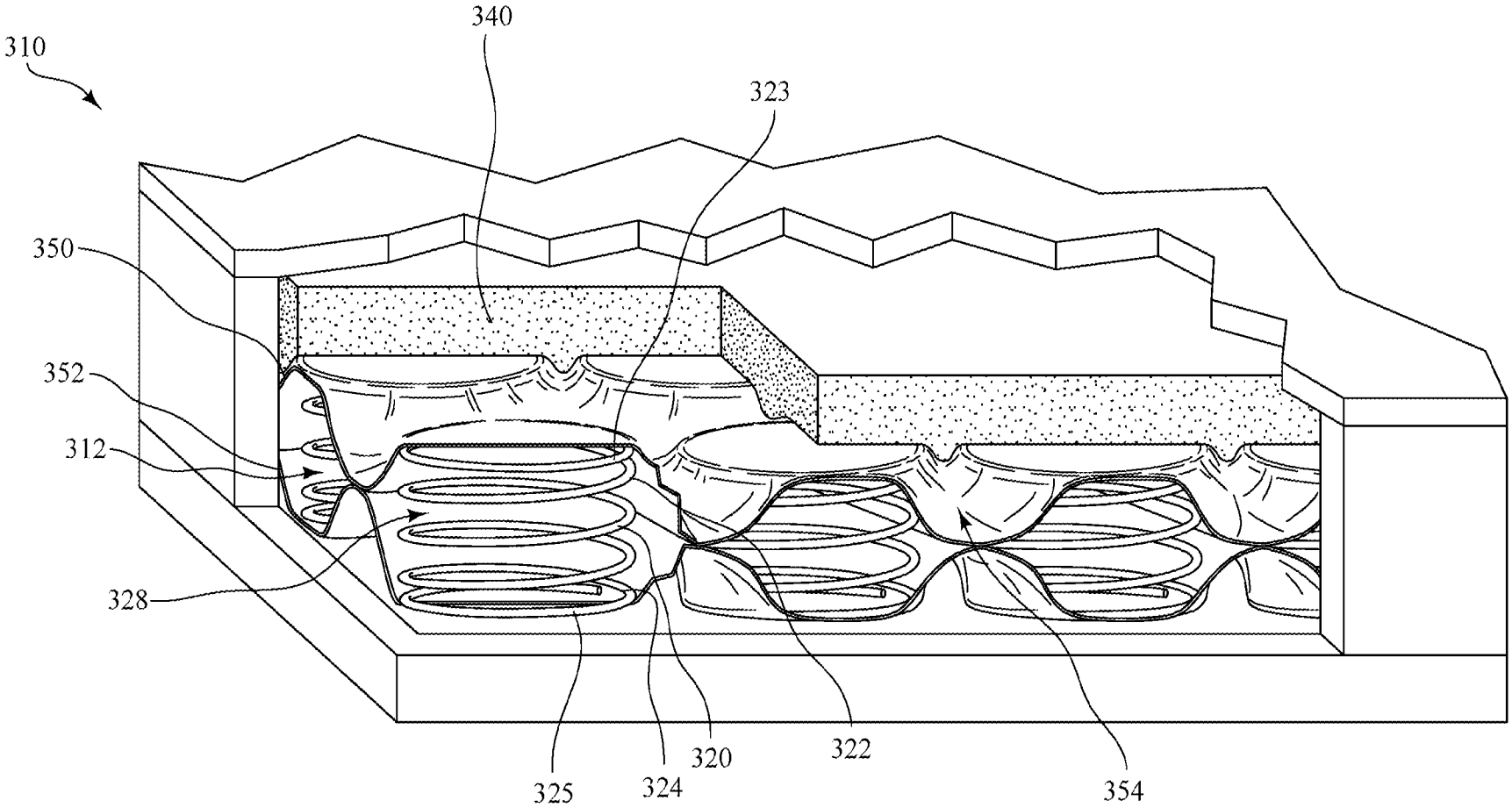
FIG. 4 is a perspective view of another exemplary mattress assembly made in accordance with the present invention, with a portion of the mattress assembly removed to show a spring core in the interior of the mattress assembly.

In some embodiments of the present invention, however, there is no recess in the interior cavity of each coil spring and the cushioning layer extends below the upper end convolution of the coil springs only into the plurality of intermediate recessed between each of the coil springs. For instance, and referring now to FIG. 4, in another exemplary spring core 312 that is provided as part of a mattress assembly 310, the spring core 312 includes a plurality of coil springs 320 having an upper portion 322 with an upper end convolution 323 of the coil spring 320 and a lower portion 324 with a lower end convolution 325 of the coil spring 320. The upper portion 322 and the lower portion 324 of the coil spring 320 collectively define an interior cavity 328 of each coil spring 320. The spring core 312 additionally includes a cushioning layer 340, a continuous upper fabric layer 350, and a continuous lower fabric layer 352 similar to the spring cores 112, 212 described above with respect to FIGS. 2 and 3. Also similar to the spring cores 112, 212 described above with respect to FIGS. 2 and 3, in the spring core 312 of FIG. 4, the continuous upper fabric layer 350 and the continuous lower fabric layer 352 are connected to one another between each of the mini coil springs 320. However, in the mattress assembly 310, the continuous upper fabric layer 350 and the continuous lower fabric layer 352 are not connected to one another within the interior cavity 328 of each of the coil springs 320. As such, in the exemplary spring core 312, there are a plurality of intermediate recesses 354 between each of the coil springs 320, but there is no recess in the interior cavity 328 of the coil springs 320. Instead, and as shown in FIG. 4, the continuous upper fabric layer 350 extends substantially flat across the upper portion 322 of each of the coil springs 320. Accordingly, the cushioning layer 340 extends below the upper end convolution 323 of each coil spring 320 only in the intermediate recesses 354 between each of the coil springs 320 and not into the interior cavity 328 of the coil springs 320.

Figure 5:
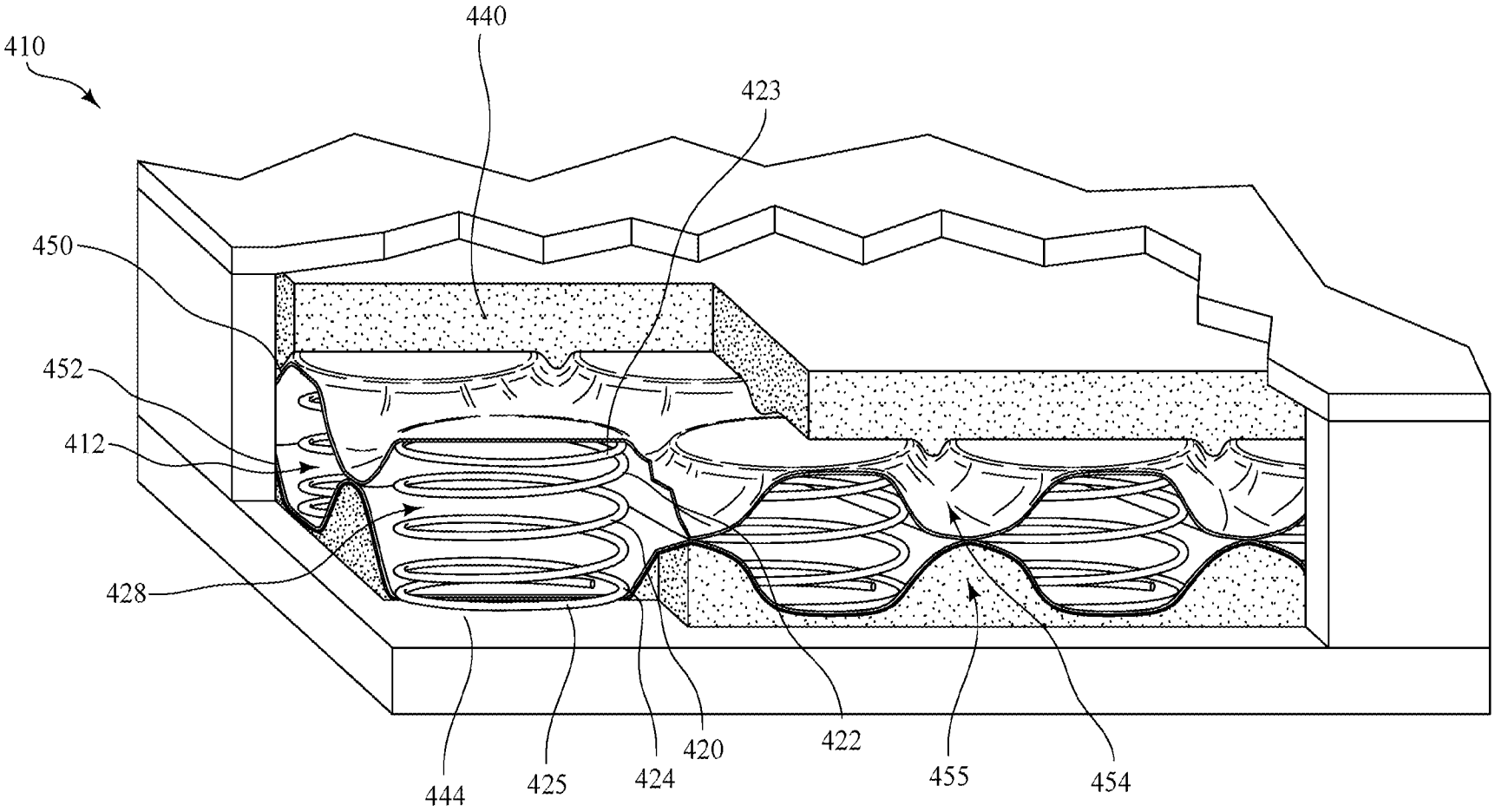
FIG. 5 is a perspective view of another exemplary mattress assembly made in accordance with the present invention, with a portion of the mattress assembly removed to show a spring core in the interior of the mattress assembly.

As a further refinement of the spring cores and mattress assemblies of the present invention, rather than the spring core having only one cushioning layer that is positioned atop the continuous upper fabric layer, it is contemplated that the spring core can further includes a second cushioning layer positioned below the continuous lower fabric layer such that both sides of the spring core provide suitable support and distribution of pressure from a user's body, or portion thereof, resting thereon. For example, in another embodiment of the present invention and referring now to FIG. 5, an exemplary spring core 412 is provided as part of a mattress assembly 410, where the spring core 412 includes a plurality of coil springs 420 having an upper portion 422 with an upper end convolution 423 of the coil spring 420 and a lower portion 424 with a lower end convolution 425 of the coil spring 420. The upper portion 422 and the lower portion 424 of the coil spring 420 collectively define an interior cavity 428 of each coil spring 420. The spring core 412 additionally includes a continuous upper fabric layer 450 and a continuous lower fabric layer 452 in a manner similar to the spring core 312 described above with respect to FIG. 4. That is to say, the continuous upper fabric layer 450 and the continuous lower fabric layer 452 in FIG. 5 are not connected to one another within the interior cavity 428 of each of the coil springs 420 and so the continuous upper fabric layer 450 defines a plurality of upper intermediate recesses 454 between each of the coil springs 420, but there is no recess in the interior cavity 428 of each of the coil springs 420. Furthermore, the continuous lower fabric layer 452 also defines a plurality of lower intermediate recesses 455 between each of the coil springs 420 that correspond to the plurality of upper intermediate recesses 454. The spring core 412 further includes a first cushioning layer 440 positioned atop the continuous upper fabric layer 450 and a second cushioning layer 444 positioned below the continuous lower fabric layer 452. As shown in FIG. 5, the first cushioning layer 440 positioned atop the continuous upper fabric layer 450 is substantially similar to the cushioning layer 340 shown in FIG. 4 and extends below the upper end convolution 423 of each coil spring 420 and into the upper intermediate recesses 454 between each of the coil springs 420. The second cushioning layer 444 similarly extends above the lower end convolution 425 of each coil spring 420 and into the lower intermediate recesses 455. Of course, a second cushioning layer similar to the one shown in FIG. 5 can also be included in any of the other exemplary spring cores and mattress assemblies of the present invention described above with respect to FIGS. 1-4.

As shown in FIGS. 1-5, each exemplary cushioning layer is shown having a thickness such that the substantially planar top surface is positioned a distance away from the underlying coil springs. It is contemplated, however, that in some embodiments of the present invention, the cushioning layer is formed with a much smaller thickness such that the planar top surface is substantially even with the upper end convolutions of the coil springs. In such embodiments, the cushioning layer is still positioned atop a continuous upper fabric layer and extends into the respective recess defined in the interior cavity of each coil spring and/or intermediate recess defined between each coil spring, but there is minimal, if any, of the cushioning layer positioned above the coil springs.

Figure 6:
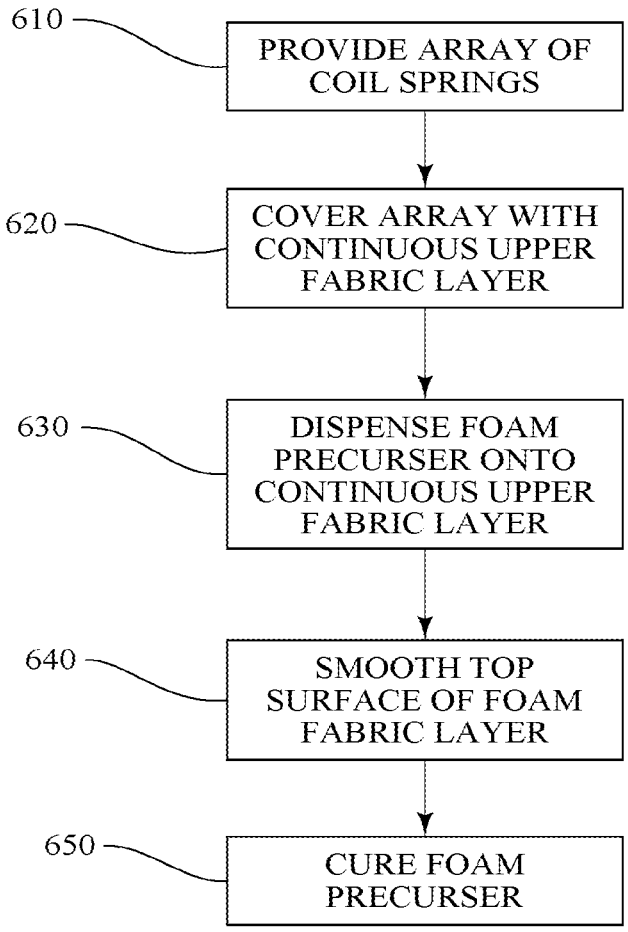
FIG. 6 is a flowchart showing an exemplary a method of producing a spring core in accordance with the present invention.

As described above, and regardless of the particular configuration of the coil springs and fabric layers utilized in the exemplary spring cores described herein, each of the spring cores are generally produced by making use of a process in which a foam precursor is applied directly to the continuous fabric layer, or layers, covering each of the coil springs. In one exemplary implementation of a method for producing a spring core, such as the spring core 12 described above, and referring now to FIG. 6, an array of coil springs (e.g., pocket coil springs) is first provided with each of the coiled springs defining an interior cavity, as indicated by step 610. Upon providing the coil spring array, the coil spring array is then covered with a continuous upper fabric layer to thereby define a recess in the interior cavity of each coil spring, between each coil spring, or both, as indicated by step 620. A foam precursor is then dispensed onto the continuous upper fabric layer, as indicated by step 630. In this regard, in some implementations of the methods for producing a spring core in accordance with the present invention, the foam precursor is dispensed onto the continuous upper fabric layer by pouring the foam precursor onto the continuous upper fabric layer as the coiled spring array is moved linearly (e.g., by linearly moving the coil spring array through a flowing vertical curtain of foam precursor) in order to evenly dispense a sufficient amount of the foam precursor onto the continuous upper fabric layer. Of course, as would be recognized by those of skill in the art, such foam precursors are generally a liquid composition that includes one or more polymeric precursors and that, upon curing, forms a solid foam product (e.g., a cushioning layer). For instance, in some implementations, the foam precursor that is dispensed onto the continuous upper fabric layer can be a visco-elastic foam precursor that is comprised of isocyanate, polyol, and other additives known in the art, and that, upon curing, is capable of forming a visco-elastic cushioning layer have a desired density and hardness. As previously stated, the foam precursor can also, in some other embodiments, be a liquid latex composition, or comprise an elastomeric gelatinous material.

Regardless of the particular composition of the foam precursor, by dispensing the foam precursor as a liquid onto the continuous upper layer, the liquid foam precursor is thus capable of not only evenly covering the entirety of the continuous upper fabric layer, but the foam precursor is also capable of completely filling the recesses defined by the continuous upper layer and extending below the upper end convolution of each coil spring into the interior cavity of each coil spring and/or between each coil spring. Then, once applied, a top surface of the foam precursor can be smoothed, as indicated by step 640, by making use of a knife blade edge, or other similar device, to create a planar top surface on the foam precursor and, eventually, the resultant set foam layer (i.e., the cushioning layer). After dispensing and smoothing the foam precursor onto the continuous upper fabric layer, the foam precursor is then allowed to cure and bond to the continuous upper fabric layer such that the foam precursor forms a set foam or cushioning layer, as indicated by step 650. For instance, in some implementations, the coil spring array with the foam precursor can be advanced through an infrared curing oven or can be cured via other means (e.g., humidity, ultraviolet light, etc.) where the time spent in curing the foam is predetermined to adequately cure the foam precursor into the set foam layer. After the foam precursor has reacted for an appropriate amount of time and the foam precursor has set, the edges of the set foam can then be trimmed as desired to produce an exemplary spring core of the present invention that provides the contact feel of foam with the underlying support of a coiled spring.

As a further refinement of the method for producing a spring core, in some implementations, it is contemplated that rather than smoothing the foam precursor prior to curing, the foam precursor can, in some embodiments be allowed to partially cure before rollers are applied to the upper surface of the partially cured foam to provide a smooth upper surface. The foam is then allowed to fully cure and set into the cushioning layer. Furthermore, in some other embodiments the foam precursor is allowed to fully cure and then the set foam is planarized (i.e., an upper portion of the set foam layer is removed) to leave a substantially planar top surface of the cushioning layer.

Of course, in some other exemplary methods for producing a spring core, such as the spring core 412 with a first cushioning layer 440 positioned atop the continuous upper fabric layer 450 and a second cushioning layer 444 positioned below the continuous lower fabric layer 452 described above, the first cushioning layer is formed according to the steps 610-650 outlined above. Then, the spring core with the first cushioning layer already formed is turned over and the second cushioning layer is formed by dispensing foam precursor onto the continuous lower fabric layer, substantially the same as described above with respect to step 630. Then, once applied, a top surface of the foam precursor can be smoothed, substantially the same as described above with respect to step 640. After dispensing and smoothing the foam precursor onto the continuous lower fabric layer, the foam precursor is then allowed to cure and bond to the continuous lower fabric layer such that the foam precursor forms the second cushioning layer, substantially the same as described above with respect to step 650, and the resulting spring core provides the contact feel of foam with the underlying support of a coiled spring on both sides of the spring core.

Throughout this document, various references are mentioned. All such references are incorporated herein by reference, including the references set forth in the following list:

REFERENCES

1. U.S. Pat. No. 4,439,977 to Stumpf, issued Apr. 3, 1984, and entitled "Method and Apparatus for Making a Series of Pocketed Coil Springs."
2. U.S. Pat. No. 4,609,186 to Thoenen, issued Sep. 2, 1986, and entitled "Mattress Spring Core with Open Ended Coils."
3. U.S. Pat. No. 6,260,223 to Mossbeck et al., issued Jul. 17, 2001, and entitled "Pocketed Coil Spring Units."
4. U.S. Pat. No. 7,185,379 to Barman, issued Mar. 6, 2007, and entitled "Foam Encased Innerspring with Internal Foam Components (Triple Case)."
5. U.S. Pat. No. 7,805,790 to DeMoss, issued Oct. 5, 2010, and entitled "Foam Springs and Innerspring Combinations for Mattresses."
6. U.S. Pat. No. 7,908,693 to DeMoss, issued Mar. 22, 2011, and entitled "Coil-in Coil Springs and Innersprings."

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A method of producing a spring core, comprising the steps of:

providing an array of coil springs, each coil spring having an upper end convolution and defining an interior cavity;

covering the array of coil springs with a continuous upper fabric layer to define a recess in the interior cavity of each coil spring, an intermediate recess between each coil spring, or both the recess in the interior cavity of each coil spring and the intermediate recess between each coil spring; and dispensing a foam precursor onto the continuous upper fabric layer such that, upon curing the foam precursor, a cushioning layer is formed atop and bonded to the continuous upper fabric layer and extends below the upper end convolution of each coil spring.

2. The method of claim 1, wherein the step of dispensing the foam precursor onto the continuous upper fabric layer comprises pouring the foam precursor onto the continuous upper fabric layer as the array of coil springs is moved linearly.

3. The method of claim 1, further comprising the step of smoothing the foam precursor, such that, upon curing, the cushioning layer has a substantially planar top surface.

4. The method of claim 1, further comprising the step of advancing the array of coil springs through an infrared curing oven subsequent to dispensing the foam precursor onto the continuous upper fabric layer.

5. The method of claim 1, further comprising the step of planarizing the cushioning layer subsequent to curing the foam precursor such that the cushioning layer has a substantially planar top surface.

6. The method of claim 1, wherein each coil spring includes a lower portion with a lower end convolution, and further comprising, prior to dispensing the foam precursor, the step of covering the lower portion of each coil spring with a continuous lower fabric layer to define the intermediate recess.

7. The method of claim 6, further comprising, prior to dispensing the foam precursor, the step of connecting the continuous lower fabric layer to the continuous upper fabric layer around each coil.

8. The method of claim 7, wherein, upon dispensing the foam precursor onto the continuous upper fabric layer, the cushioning layer extends into the intermediate recess.

9. The method of claim 6, further comprising connecting the continuous lower fabric layer to the continuous upper fabric layer in the interior cavity of each coil to define a recess.

10. The method of claim 9, wherein, upon dispensing the foam precursor onto the continuous upper fabric layer, the cushioning layer extends into the interior cavity.

11. A spring core, comprising:

a plurality of coil springs, each coil spring having an upper portion with an upper end convolution and a lower portion with a lower end convolution;

a continuous upper fabric layer covering the upper end convolution of each coil spring;

a continuous lower fabric layer covering the lower end convolution of each coil spring; and a cushioning layer defined by a precursor that is poured on to the continuous upper fabric layer wherein the precursor forms the cushioning layer and bonds to the continuous upper fabric layer, the cushioning layer being positioned atop the continuous upper fabric layer and extending below the upper end convolution of the plurality of coil springs.

12. The spring core of claim 11, wherein the continuous upper fabric layer is connected to the continuous lower fabric layer between each coil spring to thereby define an intermediate recess between each coil spring, and the cushioning layer extends into the intermediate recess.

13. The spring core of claim 11, wherein the upper portion and the lower portion of each coil spring collectively define an interior cavity of each coil spring, wherein the continuous upper fabric layer is connected to the continuous lower fabric layer within the interior cavity of each coil spring to thereby define a recess in the interior cavity of each coil spring, and wherein the cushioning layer extends into the recess of each coil spring.

14. The spring core of claim 11, further comprising a second cushioning layer positioned below the continuous lower fabric layer and extending above the lower end convolution of the plurality of coil springs.

* * * * *